US005964297A

United States Patent [19]

Edman

[11] Patent Number: 5,964,297

[45] Date of Patent: Oct. 12, 1999

[54] DRILLING METHOD AND CASING SHOE

[75] Inventor: Östen Edman, Tyresö , Sweden

[73] Assignee: Svenska Borr AB, Tyreso, Sweden

[21] Appl. No.: 09/011,396

[22] PCT Filed: Aug. 3, 1995

[86] PCT No.: PCT/SE95/00904

§ 371 Date: Feb. 3, 1998

§ 102(e) Date: Feb. 3, 1998

[87] PCT Pub. No.: WO97/06337

PCT Pub. Date: Feb. 20, 1997

[51] Int. Cl.[6] ..... E21B 19/16

[52] U.S. Cl. ..... 166/380; 166/242.8; 285/256; 285/382

[58] Field of Search ..... 285/256, 382, 285/382.4, 421; 166/242.8, 380

[56] References Cited

U.S. PATENT DOCUMENTS 1,949,668 3/1934 Watherhead, Jr. ..... 285/256
2,470,508 5/1949 Maky ..... 285/382
5,813,484 9/1998 Ekstrom ..... 175/325.2

FOREIGN PATENT DOCUMENTS

WO 9317215 9/1993 WIPO .

*Primary Examiner*—David Bagnell
*Assistant Examiner*—Chi H. Kang
*Attorney, Agent, or Firm*—Mark P. Stone

[57] ABSTRACT

During procedures in which earth layers are drilled and casing tubes are simultaneously inserted into the drilled regions, it is desirable to use casing tubes formed from a plastic material. This is accomplished by utilizing a casing shoe which is formed to provide a firm connection between the casing shoe and the casing tube. The casing shoe has an outer annular part (3) and an inner annular part (8) and corresponding conical sections (6, 11), between which the casing tube can be clamped.

6 Claims, 2 Drawing Sheets

DRILLING METHOD AND CASING SHOE

BACKGROUND OF THE INVENTION

The present invention relates to a method of performing drilling in earth layers with. simultaneous forcing in of casing tubes of plastic or similar material, and a casing shoe for bringing the casing tube with it.

When performing drilling in earth layers one uses a pilot drill bit with a reamer drill bit arranged such that it can be thrown out eccentrically relative to the pilot drill bit and enlarge the hole drilled thereby. Through this the drilled hole can get sufficient dimension to give place, in addition to the drill bit with retracted reamer, for a casing tube entered into the borehole at the same time as the hole is drilled, The casing tube is thereby driven down by a casing shoe welded to the end of the casing tube and acted on by a down-the-hole hammer. The casing tubes normally consist of three meter long steel tubes which are welded to each other when drilling and the tube has been driven down to a suitable level.

SUMMARY OF THE INVENTION

One problem with the handling of the casing tubes is their weight. Another is the possibility of corrosion which in certain cases results in exchange of them to e.g. plastic tubes after finished drilling, a complicated and time-consuming procedure.

One object with the present invention is to eliminate the exchange of casing tubes and a further object is to simplify the handling of casing tubes during the drilling. These and other objects are fullfilled through the use of casing tubes of plastic material already from the beginning, which according to the invention is made possible through a special shape of the casing shoe which gives a strong anchoring in the plastic material. Additional advantageous details appear in the claims and the detailed description.

Through the Swedish patent application 9200563-6 and the corresponding international application WO 93/17215 a casing shoe specially formed for strong anchoring in casing tubes of plastic material is known. This requires joining of plastic material through holes in the casing shoe, which can be difficult to perform with good result at the site for the drilling, why it is best suited for being prefabricated and transported joined to one length of tube to the drilling site. With a casing shoe according to the present invention no joining of plastic material through holes m the casing shoe is needed The joining of the casing shoe with the casing tube can be performed at the drilling site partly with aid of the drill hammer.

BRIEF DESCRIPTION OF THE DRAWINGS

The invention will now be described more in detail with reference to; the accompanying drawings in which.

DESCRIPTION OF THE BEST MODES FOR CARRYING OUT THE INVENTION

Figure 1:
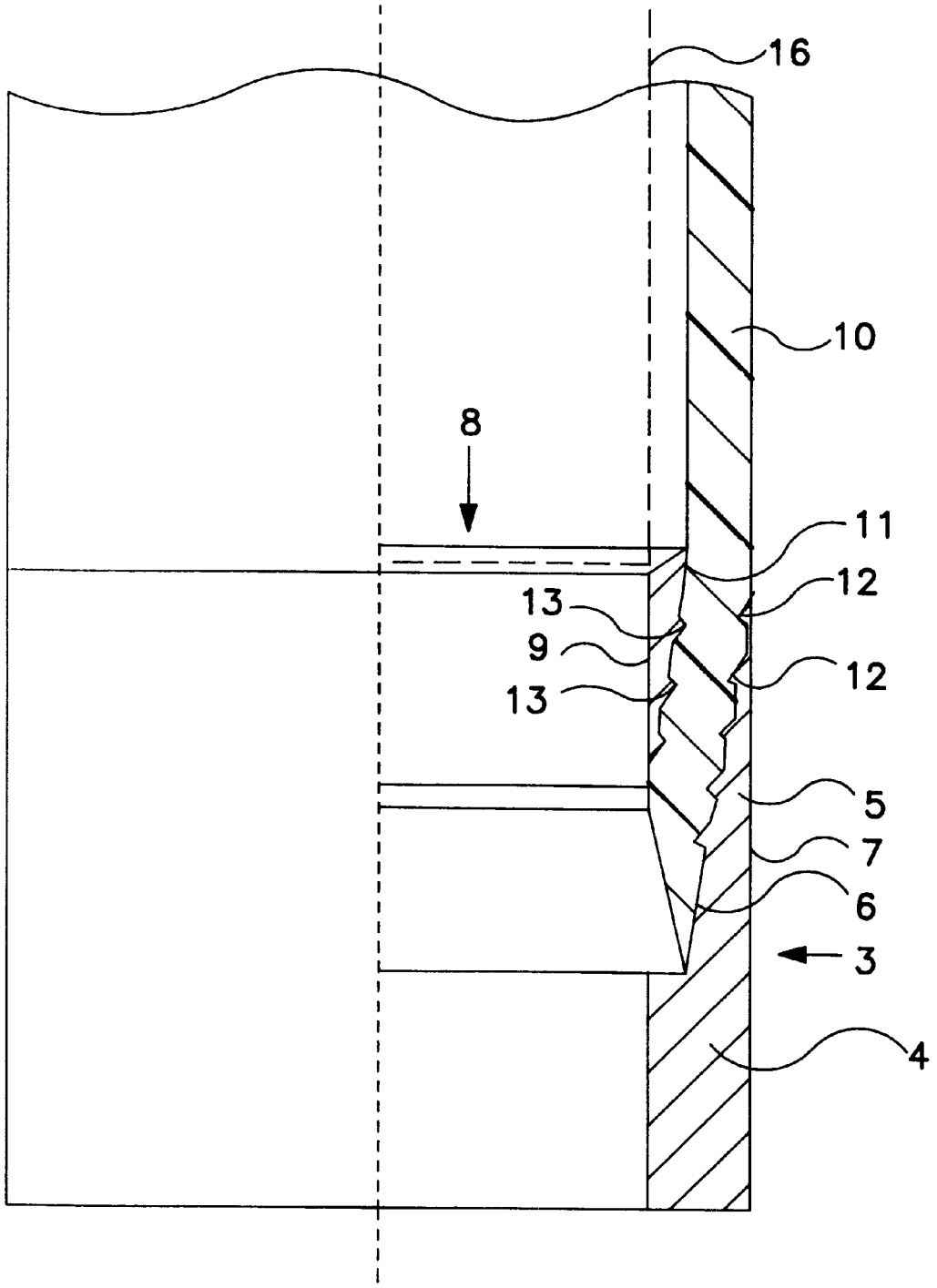
FIG. 1 shows, partly in section, the shape of a casing shoe according to the invention.

FIG. 1 shows a casing shoe according to the invention, partly in section. This is intended to be used for lining with casing tubes of plastic material or other material which cannot be welded to a conventional casing shoe It can be used with down-the-hole hammers of e.g. the type described in Swedish lay-open print 411139 but can also be used with equipment provided with other types of drill hammers. The casing shoe comprises two separate annular parts with conical sections, between which the casing tube is clamped. The outer ring 3 of the casing shoe is thus formed with a lower strong part 4 connected with an upper part 5 with a conical inner surface 6 which has a diameter which is larger than that of the lower part 4 and slowly increases until the diameter of the outer surface 7 is reached. The outer surface 7 of the outer ring 3 of the casing shoe has a substantially constant diameter along the entire length of the outer ring and it is substantially the same as the outer diameter of the casing tube 10. The inner ring 8 of the casing tube has in a corresponding way an inner surface 9 with substantially constant diameter adapted to the outer diameter of the drill hammer 16. The inner ring 8 has a substantially triangular cross-section with an impact surface and a conical outer surface 11 and with an outer diameter which decreases from the impact surface, the outer surface 11 being intended for cooperation with the conical inner surface, 6 of the outer ring so that the casing tube is clamped.

The angles for the conical surfaces 6 and 11 relative to the longitudinal axes of the rings are substantially equal. The surfaces 6 and 11 are preferably provided with projections 12 and 13 respectively which can be distributed both axially and radially. They can be annular or formed in spiral as threads. The projections can furthermore have a first surface with a small angular deviation from the main surface and a second surface with a large angular deviation from the main surface directed such that they get barbed function against drawing apart of the inner ring and the outer ring from the casing tube. Since the projections preferable are placed such that they with connected casing shoe have passed each other the locking action against separation increases. Alternatively only one of the oblique surfaces: 6 and 11 is provided with projections whereas the other has depressions lying opposite to the projections when the rings have been pressed together about the casing tube (not shown).

The pointed ends of the outer ring 3 and the inner ring 8 can be rounded in a suitable way. The surface toward the casing tube can thus be rounded to simplify the connection with the casing tube. Furthermore the outer diameter of the outer ring can be slightly decreasing and the inner diameter of the inner ring slightly increasing the last part toward respective pointed end to compensate for the deformation of these thin parts of the material which may occur because of the joining.

Figure 2:
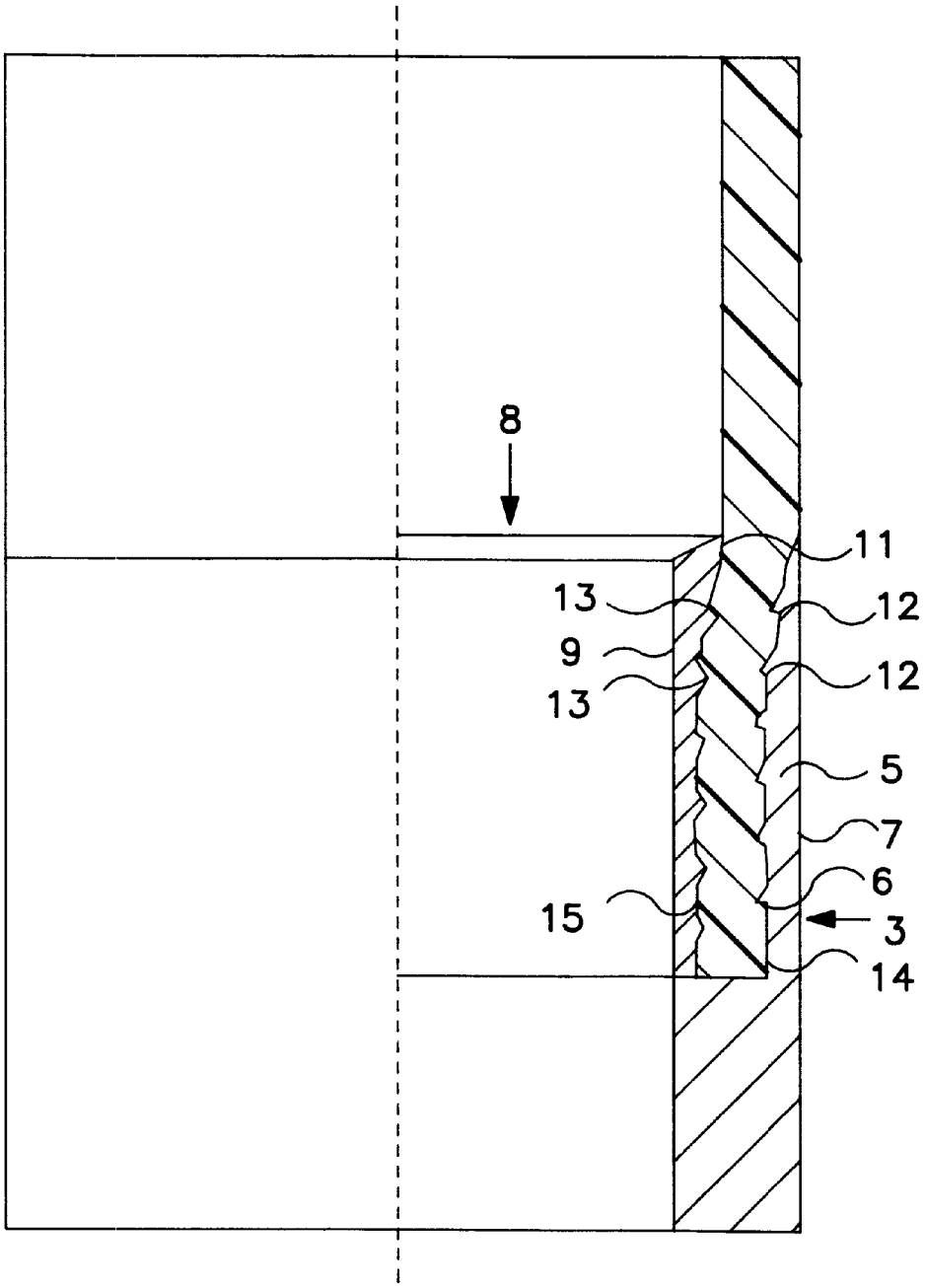
FIG. 2 shows an alternative shape of the casing shoe.

In the embodiment according to FIG. 2 the outer ring and the inner ring are modified such that they at the mounting on the casing tube completely surround the end part of the tube. This is achieved because the conical parts 6 and 11 change to cylindrical parts 14 and 15 respectively between which the end part of the casing tube can be pressed in. Thus no part of the casing tube is pressed inside the inner diameter of the casing shoe and the inner ring is adapted to reach the outer ring when mounted. As a further modification (not shown) it is possible to eliminate the middle part with the cylindrical sections 14 and 15 and thus obtain a casing shoe similar to the one in FIG. 1 but where the conical inner ring 8 reaches the lower part 4 of the outer ring when the casing shoe is mounted on the casing tube.

The casing shoe according to the invention can be applied at the end of the casing tube in the following way. An inner ring is placed in the tube with the pointed part toward the tube end but extra far into the tube. Then an outer ring is pressed or hammered onto the tube end until the casing tube has reached the lower part 4. With the aid of the drill hammer the inner ring now can be hammered into position. That part of the casing tube which comes in the way of the drill bit or the drill hammer will normally be worked away by channels in the drill or down-the-hole hammer when these rotate. Alternatively they can be worked away before the inner ring is moved into position with the drill hammer.

I claim:

1. A method of drilling in earth layers with a drill hammer arranged to act on a casing shoe which is joined at a lower end thereof to a casing tube formed from a plastic material; the steps of said method comprising:

drilling in said earth layers and simultaneously forcing said casing tube into said earth layers; and clamping said casing tube to said casing shoe between a conical section of an inner ring of said casing shoe and a conical section of an outer ring of said casing shoe.

2. The method as claimed in claim 1 further including the steps of:

clamping said casing tube to said casing shoe by placing said inner ring of said casing shoe into said casing tube; and pressing at least said conical section of said outer ring into an end of said casing tube and thereafter hammering said inner ring with said drill hammer.

3. A casing shoe and a casing tube for use with a drill hammer, said casing shoe comprising an outer annular part (3) and an inner annular part (8), said outer annular part having a conical section (6) and said inner annular part having a conical section (11), said conical sections of said outer and inner annular parts being adapted to receiving said casing tube clamped therebetween.

4. A casing shoe for a casing tube for use with a drill hammer, said casing shoe comprising an outer annular part (3) and an inner annular part (8), said outer annular part having a conical section (6) and said inner annular part having a conical section (11), said conical sections of said outer and said inner annular parts being adapted to receiving a casing tube clamped therebetween; wherein said outer annular part (3) has an outer diameter substantially corresponding to an outer diameter of said casing tube (2) adapted to be clamped to said casing shoe, and said conical section of said outer annular part has an inner diameter decreasing from said outer diameter at an end of said outer annular part, and said conical section of said inner annular part has a decreasing outer diameter and forms a part against which said drill hammer acts.

5. The casing shoe as claimed in claim 4 further including an outer ring and an inner ring defining an annular part therebetween, said annular part providing a continuation of a space between said conical section (6) of said outer annular part (3) and said conical section (11) of said inner annular part (8), said annular part providing further means for clamping said casing tube to said casing shoe.

6. A casing shoe for a casing tube for use with a drill hammer, said casing shoe comprising an outer annular part (3) and an inner annular part (8), said outer annular part having a conical section (6) and said inner annular part having a conical section (11) , said conical sections of said outer and said inner annular parts being adapted to receiving a casing tube clamped therebetween; said casing shoe further including an outer ring and an inner ring defining an annular part therebetween, said annular part providing a continuation of a space between said conical section (6) of said outer annular part (3) and said conical section (11) of said inner annular part (8), said annular part providing further means for clamping said casing tube to said casing shoe.

* * * * *